United States Patent [19]

Laube et al.

[11] Patent Number: 4,854,440

[45] Date of Patent: Aug. 8, 1989

[54] APPARATUS FOR TRANSFERRING ARTICLES TO A PACKAGING MACHINE CONVEYOR APPARATUS

[75] Inventors: Ludwig Laube, Konstanz; Helmut Leypold, Ditzingen; Erhard Pioch, Schmiden, all of Fed. Rep. of Germany

[73] Assignee: Robert Bosch GmbH, Stuttgart, Fed. Rep. of Germany

[21] Appl. No.: 213,058

[22] Filed: Jun. 29, 1988

[30] Foreign Application Priority Data

Jul. 25, 1987 [DE] Fed. Rep. of Germany ..... 3724693

[51] Int. Cl.[4] ..... B65G 37/00

[52] U.S. Cl. ..... 198/357; 198/449; 53/534

[58] Field of Search ..... 198/357, 444, 370, 449; 53/534, 250

[56] References Cited

U.S. PATENT DOCUMENTS

| | | | |
|---|---|---|---|
| 3,815,723 | 6/1974 | Wright et al. | 198/357 |
| 3,879,920 | 4/1975 | Langen | 53/506 |
| 4,178,120 | 12/1979 | Weichhand | 198/431 |

*Primary Examiner*—Robert J. Spar
*Assistant Examiner*—Cheryl L. Gastineau
*Attorney, Agent, or Firm*—Edwin E. Greigg

[57] ABSTRACT

A packaging system, in which a plurality of production machines supplying one high-capacity packaging machine has a plurality of readying devices and transfer apparatuses for the articles that are to be packaged. In order to transfer the readied articles gently and at the correct times to product buckets of the conveyor apparatus of the packaging machine, the individual transfer apparatuses are each driven by one highly dynamic electric motor in such a way that a dog of the transfer apparatus approaches a readied article slowly, then accelerates the article and then transfers the article at a synchronized speed to a bucket. The individual electric motors are controlled by a central guidance system having a process computer. The guidance system can be arbitrarily programmed such that the transfer apparatuses are not rigidly aligned with a certain succession of buckets of the conveyor apparatus, but instead can fill each successive bucket, depending on the operation of the production machines.

9 Claims, 3 Drawing Sheets

APPARATUS FOR TRANSFERRING ARTICLES TO A PACKAGING MACHINE CONVEYOR APPARATUS

BACKGROUND OF THE INVENTION

The invention is based on an apparatus for transferring articles to a packaging machine conveyor apparatus.

In a packaging system in which a plurality of production machines, such as wrapping machines, supply one high-output packaging machine, such as a cartoning machine, the capacity of which is several times that of a production machine, the conveyor apparatus has a plurality of readying devices associated with it. The articles to be packaged are readied one at a time by each readying device for transfer to a bucket of the continuously operating conveyor apparatus, in the vicinity of a transfer apparatus. In systems of this kind, known for example from U.S. Pat. Nos. 4,178,120 and 3,879,920, an endless transfer apparatus, having driver dogs, engages the readied articles and pushes them into buckets of the conveyor apparatus extending beneath it. In the known packaging systems, the transfer apparatuses each extend over a plurality of readying devices, so that one transfer apparatus transfers several articles at a time to various buckets of the conveyor apparatus.

The individual transfer apparatuses are rigidly coupled to the drive of the packaging machine, and their dogs are moved in chronological synchronism with the speed of the conveyor apparatus buckets, which means that for a certain number of readying devices, a certain succession of buckets of the conveyor apparatus is supplied with articles. Another factor is that since the transfer apparatus is driven at a uniform speed, matching that of the conveyor apparatus, its dogs strike a readied article at a relatively high speed. Such an impact can entail breakage, raising the rejection rate, in articles that are vulnerable to pressure or shock.

OBJECT AND SUMMARY OF THE INVENTION

In a packaging system of the above generic type, this disadvantage is overcome by the provisions disclosed herein. The transfer apparatus according to the invention has an advantage that its dogs approach the readied articles slowly and then accelerate them to a speed matching that of the conveyor apparatus, so that even at a high machine speed the articles are transferred extremely gently to the buckets of the packaging machine conveyor apparatus. Directly following transfer of an article, the transfer apparatus can be slowed down again, so that the transferred article and the bucket containing it can move away from the dog, the path of which at this point can be deflected outward away from the conveying path of the conveyor apparatus. There is also the advantage that by associating one transfer apparatus at a time, which has its own drive, with one readying station, and by means of a central guidance system, the program of which is readily reversible, various successions of product buckets can be supplied by any readying device and transfer apparatus, so that the conveyor apparatus of the packaging machine can be filled completely, as needed and as a function of the particular production machine in operation at the time. Moreover, the transfer apparatuses associated with the conveyor apparatus can also be identical in design.

Because the electric motor is mounted directly on the frame of the transfer apparatus, the transfer apparatuses can be mounted at any point of the packaging machine conveyor apparatus, without having to modify its construction or drive.

The invention will be better understood and further objects and advantages thereof will become more apparent from the ensuing detailed description of a preferred embodiment, taken in conjunction with the drawing.

DESCRIPTION OF THE PREFERRED EMBODIMENT

Figure 1:
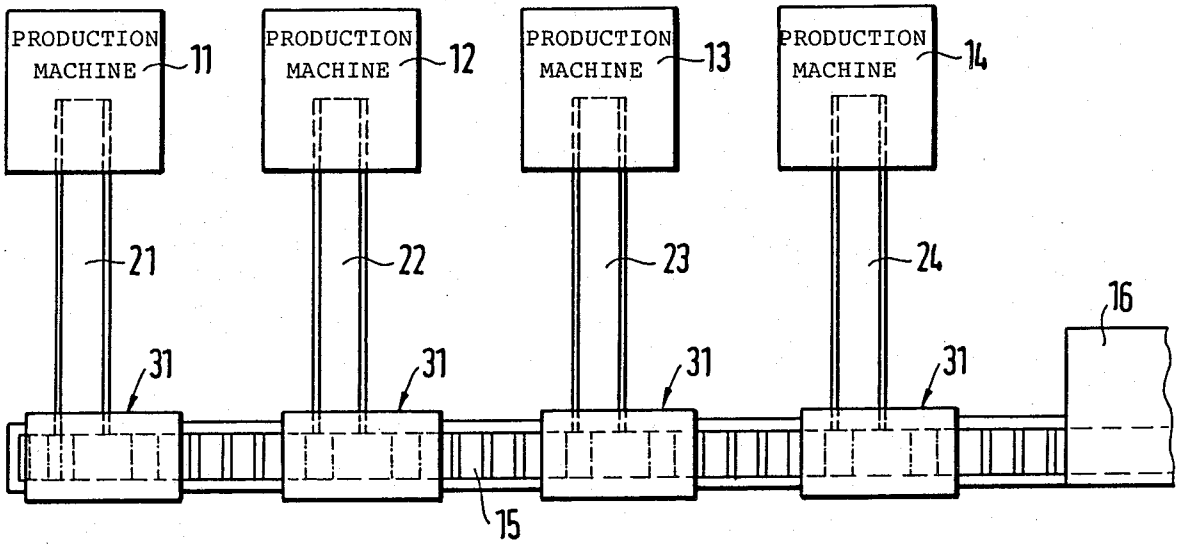
FIGS. 1 and 2 show a packaging system having four production machines and one conveyor apparatus of a packaging machine, in a simplified plan view and side view, respectively.
Figure 2:
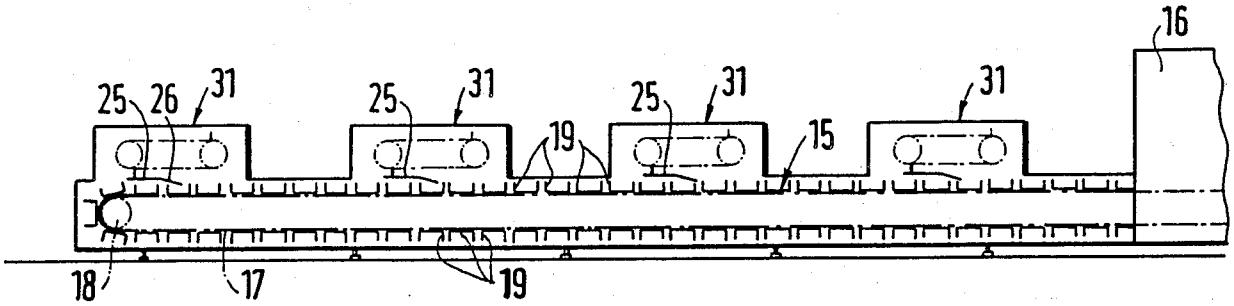
Figure 3:
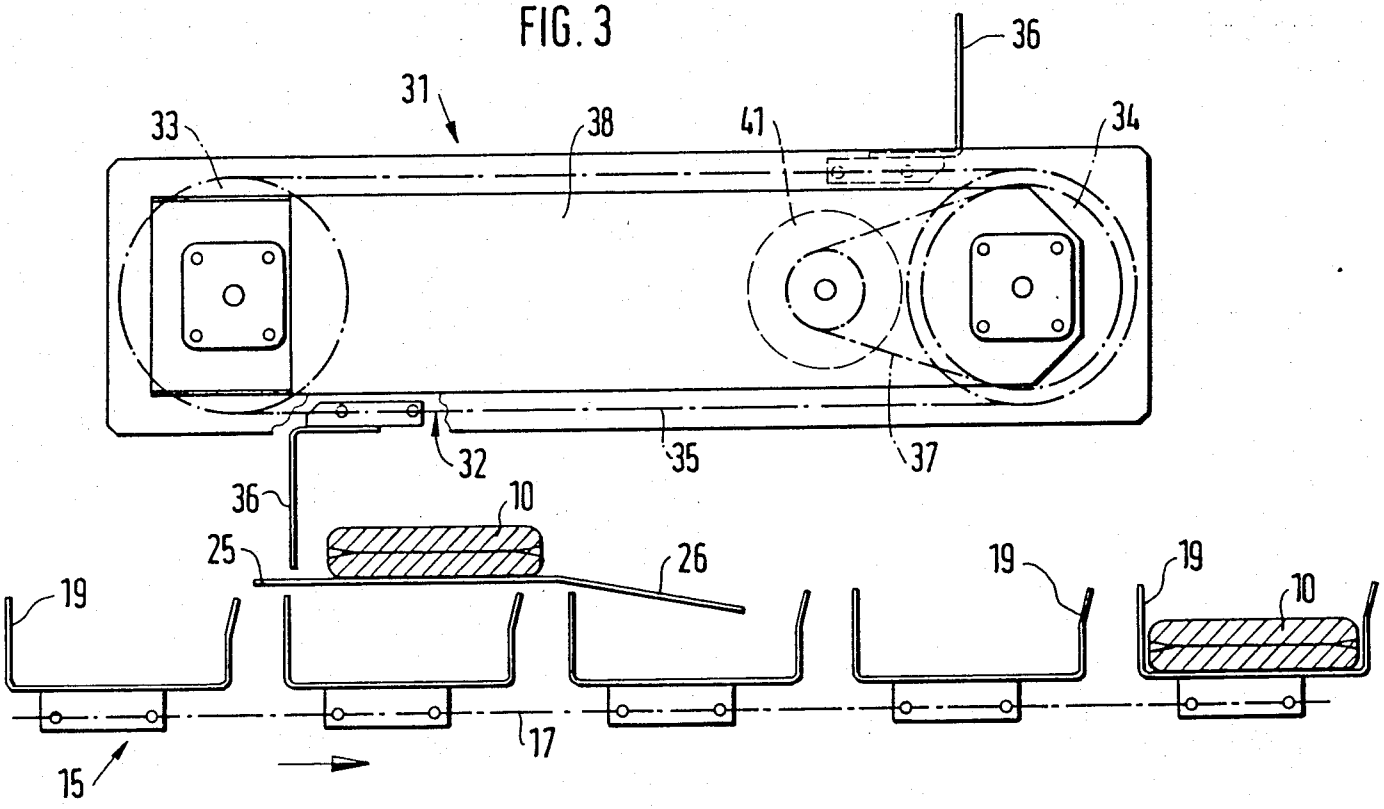
FIG. 3 is a side view of a transfer apparatus and part of the conveyor apparatus of the packaging machine.

In the packaging system shown, four production machines 11–14, such as machines for shaping, filling and sealing tubular bag packages, are associated with the conveyor apparatus 15 of a packaging machine 16. The conveyor apparatus 15 has an endless conveyor chain 17 revolving about at least one deflection roller 18 and on which U-shaped product buckets 19 are secured at uniform intervals. For supplying the buckets 19 of the conveyor apparatus 15 with articles produced by the production machines 11–14, for example tubular bag packages 10, four conveyor belts 21–24 extend transversely to the conveyor apparatus 15 from the production machines 11–14 disposed beside the conveyor apparatus 15. One table 25 each is disposed just above the conveyor path of each of the buckets 19, on their end oriented toward the conveyor apparatus 15, and on each table 25 one tubular bag package 10 is readied for transfer to a bucket 19. The end 26 of the table 25 oriented in the conveying direction of the buckets 19 of the conveyor apparatus 15 is embodied in the manner of a comb and is bent downward in the direction of travel of the buckets 19. The upper part of the side walls of the buckets 19 is likewise comb-like, so that the teeth of the buckets and of the table mesh with one another, without contact, as the conveyor apparatus revolves.

Disposed above each table 25 of one readying device is one transfer device 31, which periodically transfers one package 10 at a time, readied on the table, to a bucket 19 of the conveyor apparatus 15. Each of the transfer apparatuses 31, all of which are embodied identically, has an endless conveyor chain 32, which is guided about two deflecting wheels 33, 34 rotating about horizontal axes and the lower linear path 35 of which extends parallel above the conveyor path of the conveyor apparatus 15. Two dogs 36, which protrude outward, are disposed at equal intervals on the conveyor chain 32. The two deflecting wheels 33, 34 are rotatably supported in a frame 38, which is disposed stationary above the conveyor apparatus 15. One deflecting wheel 34 is driven via a toothed belt 37 by a highly dynamic electric motor 41. When the conveyor chain 32 of the transfer apparatus 31 revolves, one dog 36 at a time comes into contact with a package 10 readied on the table 25 and then pushes it along the table 25 to its descending end 26, such that the package 10 is aligned with the opening of a bucket 19 passing beneath it, with the leading end of the package 10 coming to rest on the leading wall of the conveyor bucket 19 and finally, upon passing the end 26, drops into the bucket 19. As a function of the uniform speed of the conveyor apparatus 15 of the packaging machine 16, the highly dynamic electric motor 41 is controlled such that the speed of the dog 36 is slowed down shortly before it meets an article readied on the table 25, and after that is accelerated again so that it matches the speed of the conveyor apparatus 15. At the time the package 10 is transferred, it has attained the same speed as the bucket 19, so that at the same phase location as the bucket 19 it drops into it after passing the end 26 of the table 25.

Figure 4:
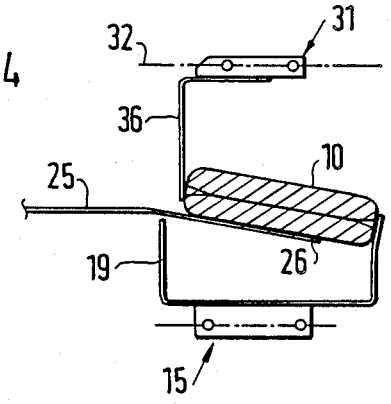
FIG. 4 shows part of the transfer apparatus of FIG. 3, in a different operating position from that shown in FIG. 3.
Figure 5:
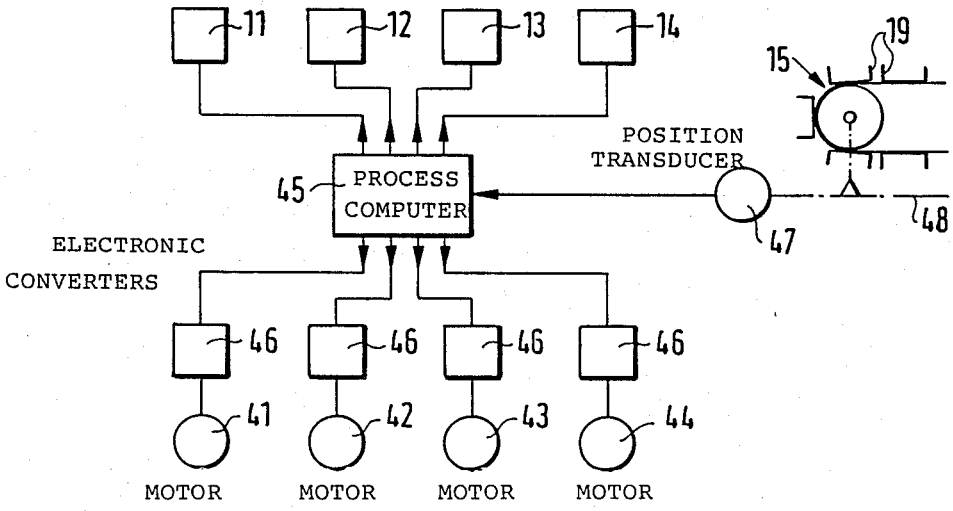
FIG. 5 is a simplified circuit diagram of the packaging system.

In cases where the product packaged in the tubular bag packages 10 is loose, and the packages are to be packed in a container package, such as a folding box, the packages 10 are somewhat overpressured between the front end of bucket 19 and the dog 36, FIG. 4. To this end, the speed of the transfer apparatus 31, or of its electric motor 41, is controlled such that the leading end of the package 10 meets the leading wall of the bucket 19, the speed of the dog 36 being somewhat higher than the speed of the conveyor bucket 19. This compresses the package 10 in such a way that its width becomes somewhat less than the width of a bucket 19, so that in the ensuing slowing down of the speed of the dog 36, the package 10 drops without play into the bucket 19. After the package 10 has been transferred, the speed of the transfer apparatus 31 is still somewhat slowed, so that the bucket 19 with the package 10 placed in it can move away from the dog 36 as the dog pivots upward at the deflecting wheel 34.

For adapting the increasing and decreasing course of the speed of each of the transfer apparatuses 31 as a function of the constant speed of the conveyor apparatus 15 of the packaging machine 16, an electronic guidance system having a process computer 45 is associated with the electric motors 41–44 of the transfer apparatuses 31. This process computer 45 receives reference signals, dependent on the phase location of the buckets 19, from a position transducer 47 connected to the main shaft 48 of the packaging machine 16. Taking into consideration the period of time for transporting the packages 10 from the production machines 11–14 to the readying tables 25, the process computer 45 orders the transfer of packages 10 as a function of the phase location of the conveyor apparatus 15. The conveyor belts 21–24, which are driven likewise uniformly by the packaging machine 16, then convey the packages that have been ordered to the readying tables 25 during a predetermined period of time. The packages 10 readied there are then, as described above, transferred to the buckets 19 of the conveyor apparatus 15 of the packaging machine 16; the process computer 45 controls the rpm of the electric motors 41–44 via electronic converters 46. Such electronic converters 46, as well as the highly dynamic electric motors 41, are available on the market by the name PUMASYN ®, for regulating drives made by the company doing business as AMK, Arnold Moller, Kirchheim/Teck, Federal Republic of Germany.

The process computer 45 is preprogrammed as a function of the physical characteristics of the packaging system. In the exemplary embodiment described above, it is assumed that the production machines 11–14 are in operation simultaneously and that packages 10 are delivered at the same time to all four transfer apparatuses 31, which then transfer them to the buckets 19 of the conveyor apparatus 15, each of the four transfer apparatuses 31 supplying every fourth bucket 19. The guidance system may, however, also be reprogrammed in a simple manner such that if only three production machines are in operation, for example, then the associated transfer apparatuses 31 fill every third bucket 19 of the conveyor apparatus 15. This is important in the event that one of the four production machines 11–14 breaks down, or that one of these production machines is kept in readiness as a standby machine, which is put into operation only if another production machine breaks down, if a quantity of products stored beforehand must be processed, or if the preceding production system temporarily produces a greater output of products. With such simply programmed control, it is possible to fill all the buckets 19 of the conveyor apparatus 15, without regularly having idle buckets or idle cycles if one of the production machines shuts down. A further advantage is that at a later time, additional production machines can be incorporated into the packaging system without having to modify the delivery system. Conversely, the packaging machine can be slowed down in speed if a production machine is turned off, yet all the buckets of the cartoning machine will still be filled.

The foregoing relates to a preferred exemplary embodiment of the invention, it being understood that other variants and embodiments thereof are possible within the spirit and scope of the invention, the latter being defined by the appended claims.

What is claimed and desired to be secured by Letters patent of the United States is:

1. An apparatus for transferring articles to successive buckets of a continuously operating conveyor apparatus of a packaging machine having at least one device for readying articles, and one transfer apparatus associated with each of said at least one readying device and the conveyor apparatus at one time, each said transfer apparatus comprising an endless conveyor having outwardly extending dogs and extending above an outlet end of a readying device and above said conveyor apparatus, each transfer apparatus transferring one readied article to a successive bucket of said conveyor apparatus, each transfer apparatus (31) including a first drive that is separate from a second drive of said conveyor apparatus (15), said first drive including a highly dynamic, variable-speed electric motor (41–44), a guidance system including a programmable process computer (45) associated with each of said electric motors, said guidance system controlling a rotational speed of each of said electric motors as a function of a phase location of said conveyor apparatus (15), said guidance system controlling said electric motor such that the speed of each of said dogs is slowed shortly before it reaches one of said readied articles and thereafter is accelerated to match a speed of the conveyor apparatus and to accelerate said readied article to substantially the speed of the conveyor apparatus to transfer said article to a bucket (19) of the conveyor apparatus (15) at a virtually synchronous speed.

2. An apparatus as defined by claim 1, in which prior to a transfer of an article (10) to said bucket (19), upon alignment of said article with said bucket, said dog (36) briefly has a somewhat higher speed than said bucket, so that said article being transferred is compressed between a leading wall of said bucket and said dog of said transfer apparatus (31).

3. An apparatus as defined by claim 1, in which each of said highly dynamic electric motors (41–44) are controlled by a converter (46) which is connected to said process computer (45).

4. An apparatus as defined by claim 2, in which each of said highly dynamic electric motors (41–44) are controlled by a converter (46) which is connected to said process computer (45).

5. An apparatus as defined by claim 1, in which each of said highly dynamic electric motors (41–44) are installed in a frame (38) of each said transfer apparatus (31).

6. An apparatus as defined by claim 2, in which each of said highly dynamic electric motors (41–44) are installed in a frame (38) of each said transfer apparatus (31).

7. An apparatus as defined by claim 3, in which each of said highly dynamic electric motors (41–44) are installed in a frame (38) of each said transfer apparatus (31).

8. An apparatus as defined by claim 4, in which each of said highly dynamic electric motors (41–44) are installed in a frame (38) of each said transfer apparatus (31).

9. A method of transferring articles from a plurality of side-by-side production machines into successive buckets of a conveyor which comprises:

transferring articles from said production machines onto side-by-side supports, moving an endless conveyor having successively spaced buckets thereon below said side-by-side supports at a constant speed, moving a transfer belt having outwardly extending dogs above each of said side-by-side supports to remove said articles from each of said side-by-side supports into successive buckets of said endless conveyor, controlling each of said transfer belts to provide variable speeds relative to movement of said endless conveyor by slowing the speed of the transfer belt before a dog on the transfer belt reaches one of said articles on one of said side-by-side supports and thereafter accelerating the transfer belt to accelerate the article to a speed matching a speed of said endless conveyor, whereby each of said articles are placed in successive buckets of said endless conveyor successively by said side-by-side transfer belts without any damage to said articles.

* * * * *